United States Patent [19]

Tanaka et al.

[11] 4,179,618

[45] Dec. 18, 1979

[54] APPARATUS FOR ION-NITRIDING TREATMENT

[75] Inventors: Akio Tanaka, Ono; Mizuo Edamura, Kobe; Satoshi Furuitsu, Kakogawa; Satoru Kunise, Akashi, all of Japan

[73] Assignee: Kawasaki Jukogyo Kabushiki Kaisha, Hyogo, Japan

[21] Appl. No.: 855,908

[22] Filed: Nov. 29, 1977

[30] Foreign Application Priority Data

Dec. 1, 1976 [JP] Japan ..... 51/145102
Dec. 1, 1976 [JP] Japan ..... 51/145103
Dec. 1, 1976 [JP] Japan ..... 51/145104

[51] Int. Cl.[2] ..... B01K 1/00
[52] U.S. Cl. ..... 250/531; 148/16.6; 204/177
[58] Field of Search ..... 250/531; 204/177; 148/16.6; 13/31.32; 118/49.1; 427/39

[56] References Cited

U.S. PATENT DOCUMENTS 3,736,360 5/1973 Bergman et al. ..... 13/31

FOREIGN PATENT DOCUMENTS 1262897 2/1972 United Kingdom .

OTHER PUBLICATIONS

Denton, R. A., "Differentially Pumped Ion Nitriding Furnace", *J. Vac. Sci. and Tech.* 8(1), Feb. 1971, pp. 328–331.

*Primary Examiner*—Benjamin R. Padgett
*Assistant Examiner*—Deborah L. Kyle
*Attorney, Agent, or Firm*—Wenderoth, Lind & Ponack

[57] ABSTRACT

An ion-nitriding apparatus which is designed so that in heating and nitriding a workpiece by the combined use of glow discharge and heat generated by a heat-producing element, uniform temperature distribution of the workpiece during glow discharge can be obtained, thereby preventing overheating of the workpiece and realizing uniform heating and uniform nitriding of the workpiece.

2 Claims, 6 Drawing Figures

APPARATUS FOR ION-NITRIDING TREATMENT

BACKGROUND OF THE INVENTION

This invention relates to an apparatus for ion-nitriding treatment in which nitrogen gas molecules are ionized by glow discharge and the nitrogen ions thus produced are made to collide with a workpiece for nitriding treatment.

DESCRIPTION OF THE PRIOR ART

Generally, when a workpiece is heated by ion-bombarding of nitrogen-ion and hydrogen-ion to be ionized by glow discharge, FeN is generated by the combination of Fe atom which breaks out of the surface of the workpiece by ion-bombarding and N atom in the atmosphere evaporates and adheres to the surface by the surface cleaning action, and there is a resultant increase in nitrogen potential at the surface. Due to this increase in nitrogen potential and other reasons, an extremely dense (porous-free) surface nitrided layer can be formed in a short time. Since the workpiece is treated under vacuum of 1–10 Torr, treating gas can be used efficiently, free from environmental pollution. For the treating gas, either cracked gas or $NH_3$ or mixed gas of $N_2$ and $H_2$ is used.

In the conventional apparatus of this kind, glow discharge is generated by impressing DC voltage under vacuum (1–10 Torr) in a metallic receptacle with a workpiece as cathode and the receptacle wall as anode. Nitrogen gas molecules are ionized by this glow discharge and the workpiece is heated while the nitrogen-ions are made to collide with the workpiece; then the discharge nitriding treatment of the workpiece is carried out while keeping the workpiece at the required treating temperature by glow discharge.

In the conventional ion-nitriding apparatus, however, heating and nitriding of a workpiece is carried out solely by glow discharge and accordingly it has been difficult to obtain the uniform temperature distribution of the workpiece during glow discharging. Moreover, since the temperature control of the workpiece is exercised by the strength of glow discharge, it is difficult to carry out accurate temperature control, with the result that overheating of the workpiece and other trouble will take place, thereby making it impossible to carry out good and uniform nitriding.

SUMMARY OF THE INVENTION

In view of the above-mentioned defects of the conventional ion-nitriding apparatus, the present invention contemplates to provide an ion-nitriding apparatus wherein the uniform temperature distribution of the workpiece can be obtained by heat generated by a heat-producing element in combination with the conventional glow discharge and wherein accurate temperature control is made possible by carrying out the temperature control of the workpiece by controlling the heat generation by the above-mentioned heat-producing element or by the combination of the heat generation control on the heat-producing element and glow discharge control. Thus overheating of the workpiece is prevented, and uniform heating and uniform nitriding are made possible.

According to the present invention, while heating and nitriding of the workpiece are carried out by the combined use of glow discharge and heat generated by the heat-producing element, the temperature control is mainly based on the heat generation control on the heat-producing element which is easy to control and has good responsiveness, instead of the glow discharge control which is difficult to exercise and has poor responsiveness. In other words, the temperature control is effected by the heat generation control on the heat-producing element or by the combination of the heat generation control on the heat-producing element and the glow discharge control.

Furthermore, according to the present invention, by controlling the voltage to be impressed upon the above-mentioned heat-producing element, generation of arc discharge between heat-producing element terminals, between the heat-producing element terminal and the anode or between the heat-producing element and the anode can be prevented, and also the outbreak of unusual glow discharge and damage on the heat-producing element, the heat-producing element terminal and the anode by arc discharge can be prevented. In carrying out heating and nitriding of the workpiece by the combined use of glow discharge and heat generated by the heat-producing element, impressing of voltage upon the above-mentioned heat-producing element is carried out under vacuum (1–10 Torr) and at a high temperature (300°–570° C.). However, at this time when it is difficult to obtain the insulator having excellent electric-insulating property with heat resisting (insulating), if voltage of more than 220 V is impressed upon the heat-producing element, it is impossible to insulate the heat-producing element terminal perfectly, with the result that there is the possibility of arc discharge between the heat-producing element terminals, between the heat-producing terminal and the anode and between the heat-producing element and the anode being generated, and also unusual glow discharge and damage on the heat-producing element, heat-producing element terminal and anode can be caused. Therefore, the present invention is so designed that the voltage to be impressed upon the above-mentioned heat-producing element is controlled within 220 V, preferably within 110–120 V.

Moreover, according to the present invention the above-mentioned heat-producing element is divided into at least two sections in lateral direction, so that the temperature distribution in the furnace is kept uniform by controlling the output from each divided heat-producing element individually while heating and nitriding of the workpiece are carried out by the combined use of glow discharge and heat generated by the heat-producing element.

BRIEF DESCRIPTION OF THE DRAWINGS

The nature and advantage of the present invention will be understood more clearly from the following description made with reference to the accompanying drawings, in which.

DETAILED DESCRIPTION OF PREFERRED EMBODIMENTS

Embodiment No. 1

Figure 1:
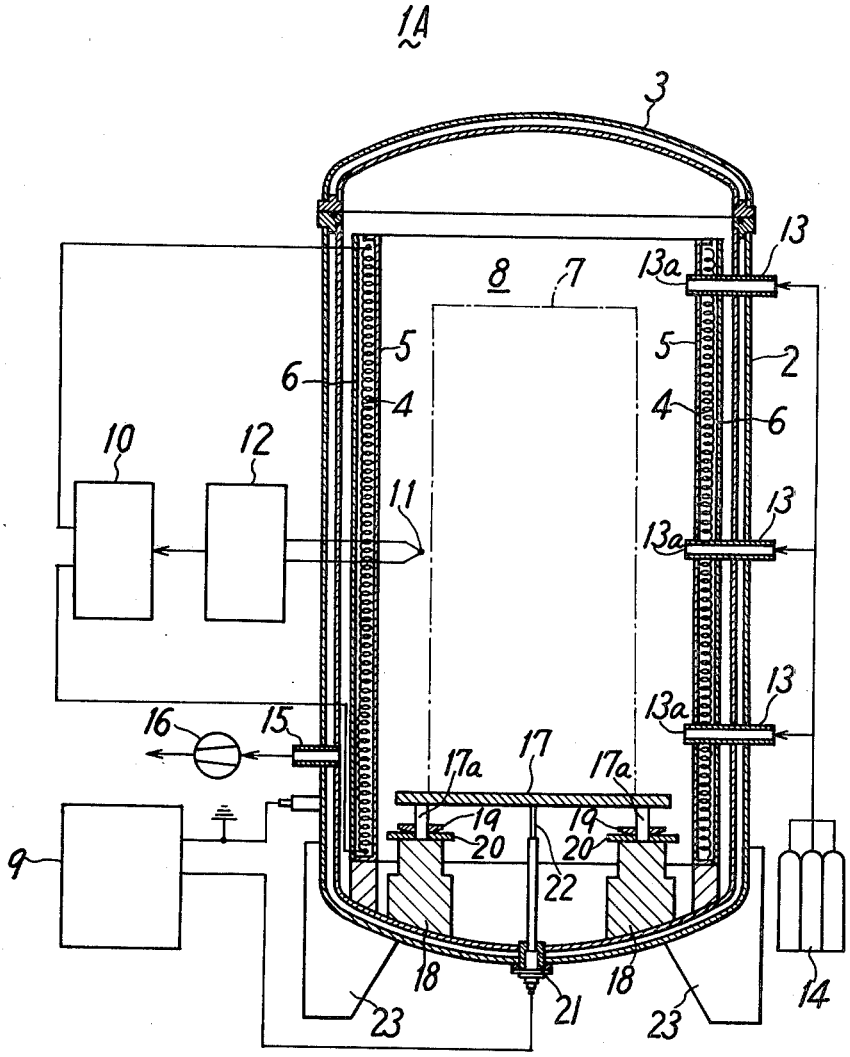
FIG. 1 is a vertical section showing Embodiment No. 1 of the apparatus of the present invention.
Figure 2:
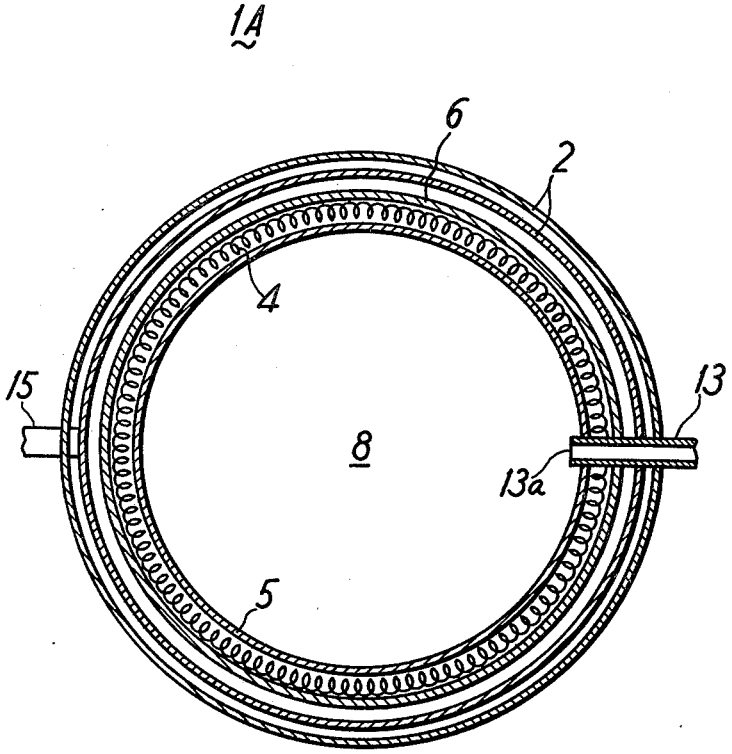
FIG. 2 is a cross section of the apparatus shown in FIG. 1.

In FIG. 1 and FIG. 2, numeral 1A designates a vacuum reacting furnace made of stainless steel or steel which has a cylindrical furnace body 2 and a lid 3 to cover an upper opening part (inlet and outlet for workpieces) of the furnace body 2. Both the furnace body 2 and the lid 3 are of water-cooling double construction so that they are kept cooled to the proper temperature. A heat-producing element 4 to be arranged in cylinder shape, such as a tubular graphite cloth heat-producing element, a sheath heater, a nichrome heat-producing element, etc., is disposed in the vacuum reacting furnace 1A, around the circumference and concentric with the furnace body 2. A cylindrical inner wall screen body 5 is provided inside the circumference of the heat-producing element 4 in such a fashion that it screens electrically the inner circumferential side of the heat-producing element 4 from a workpiece (cathode). Provided outside the circumference of the heat-producing element 4 is an annular outer wall cover body 6 comprising an insulating material, such as graphite felt of high purity, ceramic fiber, etc. or heat reflecting plate. Under this arrangement, space at the inner circumferential side of the inner wall screen body 5 in the vacuum reacting furnace 14 is the space 8 in which workpieces 7 are put. Numeral 9 is a power source for glow discharge to impress DC voltage between the anode or the aforementioned inner wall screen body 5 and the cathode or the workpiece 7 put in the space 8. Numeral 10 is a power source for heat-producing element to impress AC voltage upon the afore-mentioned heat-producing element 4. Connected to the power source 10 for the heat-producing element is a temperature controlling device 12 equipped with a thermocouple 11 for temperature measuring inserted into the space 8, whereby the temperature in the furnace 1A is detected for controlling the power source for the heat-producing element 10.

Numeral 13 is a gas-introducing pipe for introducing treating gas (mixed gas of $N_2$ and $H_2$, for example) into the vacuum reacting furnace 1A. Its opening part 13a is open into the space 8 and passes through the furnace body 2, the outer wall cover body 6, the heat-producing element 4 and the inner wall screen body 5. The other end of the pipe 13 is connected to a treating gas mixing and supplying device 14. In this embodiment, the gas-introducing pipe 13 is provided at three portions of the body: upper, middle and lower. A vacuum suction pipe 15 provided at the lower portion of the furnace body 2, opposite the gas-introducing pipe 13, is open at the inner circumferential surface of the furnace body 2 (or the inner circumferential surface of the inner wall screen body 5) and has its other end connected to a vacuum pump 16.

Numeral 17 is a cathode mounting table on which a workpiece 7 is mounted. The table 17 is supported by a three-legged supporting stand made of insulating material 18, 18, 18 at the bottom of the vacuum reacting furnace 1A. In order to prevent glow discharge from becoming concentrated upon the part at which a leg portion 17*a* of the cathode mounting table 17 makes contact with the supporting stand 18, an electric-conductive disc 19 with its underside convexed and a disc made of insulating material 20 with its upper side flattened are laid one upon the other so that a wedge-shaped gap is formed between the two. Numeral 21 is a guide pipe having electrical insulating properties and vacuum sealing property to introduce a cathode terminal 22 from outside of the vacuum reacting furnace 1A to the cathode mounting table 17. Numeral 23 is a support leg for the vacuum reacting furnace 1A.

In the ion-nitriding apparatus of the above-mentioned type, under the condition where $H_2$ gas or inert gas such as Ar has been supplied from the treating gas mixing and supplying device 14 into the vacuum reacting furnace 1A which is vacuum-exhausted to the degree of 1–10 Torr, the temperature of the workpiece 7 is raised uniformly to the temperature at which discharge nitriding is possible (300–570° C.) by heat generated by the heat-producing element 4 and/or glow discharge. After the required treating temperature has been attained, nitriding of the workpiece 7 is carried out by glow discharge while keeping the workpiece 7 at the treating temperature by heat generated by the heat-producing element 4. Thus, heating and nitriding of the workpiece 7 can be effected at high thermal efficiency and uniformly. At this time, AC voltage to be impressed upon the heat-producing element 4 from the power source 10 for the heat-producing element is controlled by the temperature controlling device 12 for detecting the temperature in the furnace 1A and, accordingly, heat generated by the heat-producing element 4 is also controlled. Thus, the temperature of the workpiece 7 is controlled to the proper temperature (300°–570° C.) and overheating of the workpiece 7 is prevented. In this embodiment, the voltage of glow discharge is kept constant. Since the heat-producing element 4 is arranged in such a fashion that it is screened electrically from the workpiece 7 (cathode) by the screen body 5 (and the cover body 6), there is no fear that arc discharge or unusual glow discharge is generated between the heat-producing element 4 and the workpiece 7 (cathode).

Embodiment No. 2

Figure 3:
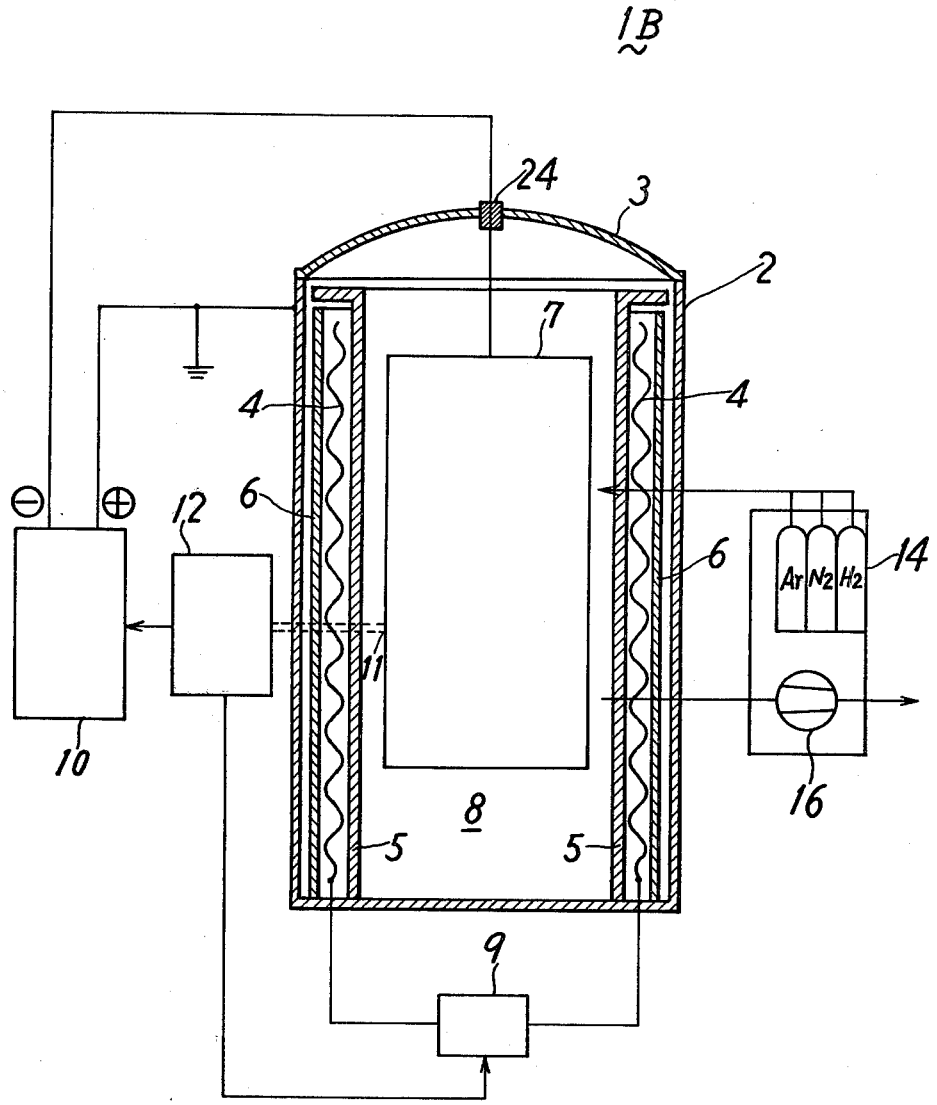
FIG. 3 is an outline, in vertical section, of Embodiment No. 2 of the apparatus of the present invention.

As shown by FIG. 3, this embodiment is the case where the above-mentioned temperature controlling device 12 is connected to both the power source 10 for the heat-producing element and the power source 9 for glow discharge so as to carry out the temperature control on the workpiece 7 in the vacuum reacting furnace 1B by the combination of heat generation control on the heat-producing element 4 and glow discharge control. In FIG. 3, the simplified construction in the case where the cathode of the power source for glow discharge 9 is introduced through an electric-insulating vacuum sealing material 24, from which the workpiece 7 is suspended, is shown. In FIG. 3, the same composing elements and means as in FIG. 1 are shown by like numerals.

Embodiment No. 3

Figure 4:
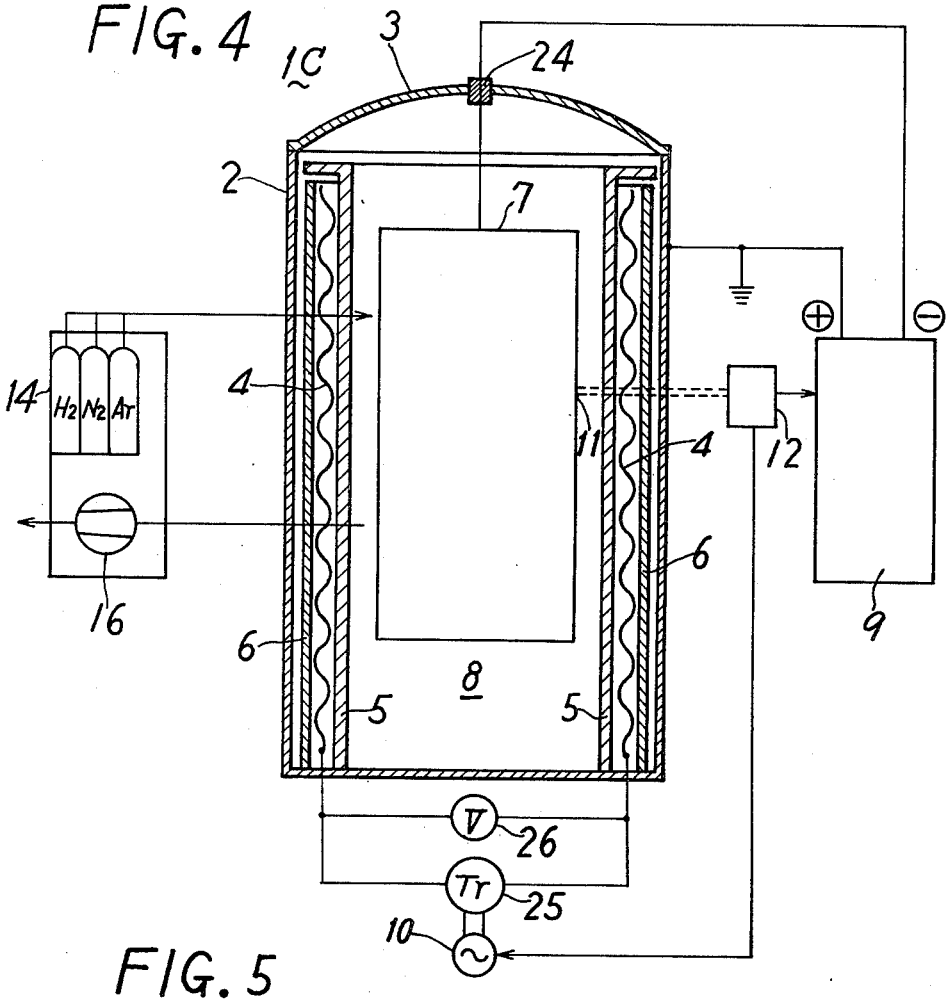
FIG. 4 is an outline, in vertical section, of Embodiment No. 3 of the apparatus of the present invention.
Figure 5:
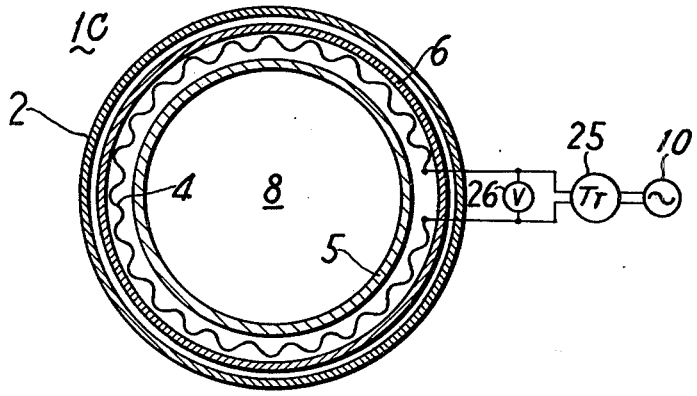
FIG. 5 is a cross section of the apparatus shown in FIG. 4.

As shown by FIG. 4 and FIG. 5, this embodiment is intended to control the maximum voltage to be impressed upon the heat-producing element 4. Voltage to be impressed upon the heat-producing element 4 is controlled at less than 220 V by a transformer 25. Numeral 26 is a voltmeter for measuring the voltage between terminals of the heat-producing element 4. In this embodiment the temperature controlling device 12 is used for controlling the voltage to be impressed by the power source 9 for glow discharge, similar to Embodiment No. 2. The other construction and means are the same as in the case of Embodiment No. 2.

In this embodiment, voltage to be impressed upon the heat-producing element 4 is controlled so that it is set below 220 V, preferably 110–120 V. This is because if the voltage impressed upon the heat-producing element 4 is more than 220 V, it involves impressing under vacuum even if the terminal of the heat-producing element 4 is usually insulated such as atmospheric pressure and therefore arc discharge is apt to take place between both terminals, between both terminals and the inner wall screen body 5 or between the heat-producing element 4 and the inner wall screen body 5, with the result of unusual glow discharge, uneven heating, uneven nitriding and damage on the heat-producing element 4 and the inner wall screen body 5 by overheating.

Embodiment No. 4

Figure 6:
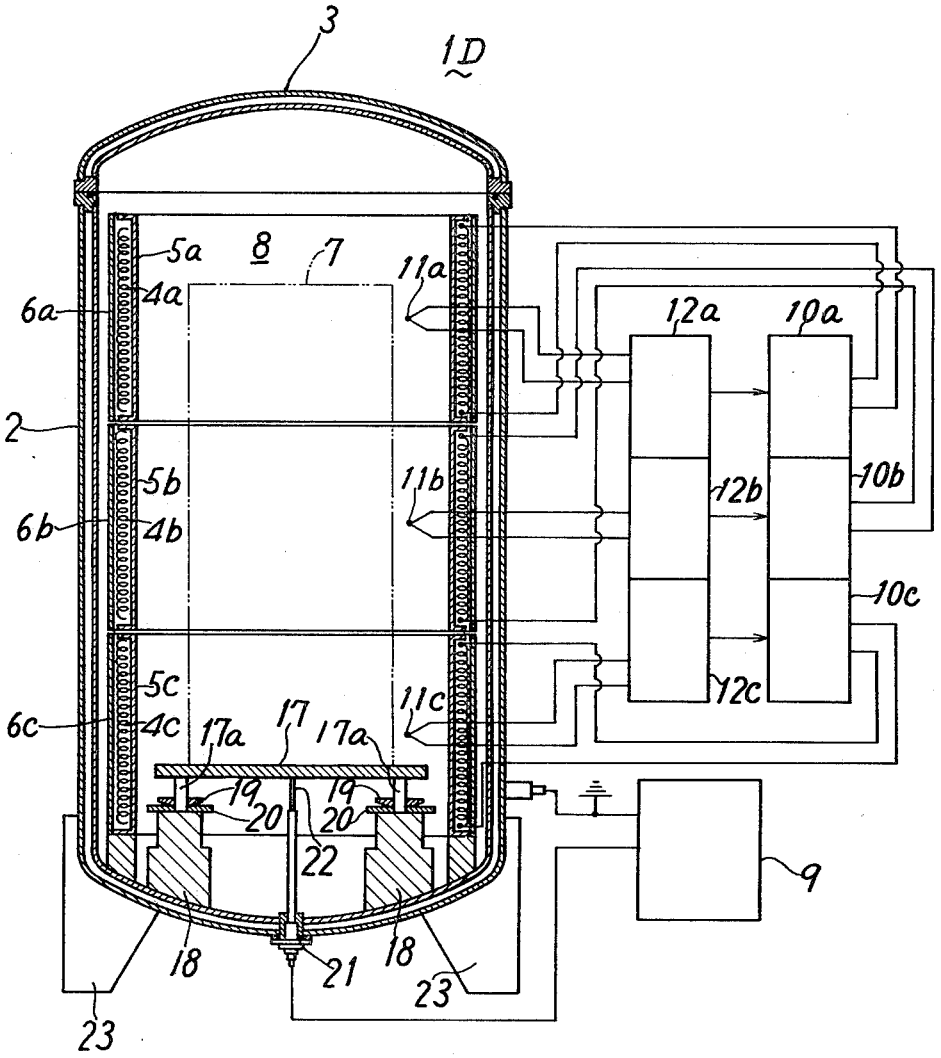
FIG. 6 is a vertical section of Embodiment No. 4 of the apparatus of the present invention.

As shown by FIG. 6, this embodiment is the case where the heat-producing element is divided into three sections laterally, or more particularly, an upper heat-producing element 4a, a middle heat-producing element 4b and a lower heat-producing element 4c. All three sections are cylinder-shaped and arranged in stages vertically around the circumference of the vacuum reacting furnace 1D. Divided heat-producing elements 4a, 4b, 4c are screened electrically by cylindrical inner wall screen bodies 5a, 5b, 5c at their inner circumferences and cylindrical outer wall cover bodies 6a, 6b, 6c at their outer circumference respectively from the workpiece 7 (cathode).

10a, 10b and 10c designated power sources for the heat-producing elements and impress AC voltage upon the aforementioned heat-producing elements 4a, 4b, 4c respectively. The power source 10a for the upper heat-producing element is connected to an upper temperature controlling device 12a equipped with an upper thermocouple 11a for temperature measuring inserted in the upper position inside the vacuum reacting furnace 1D. Similarly, the power source 10b for the middle heat-producing element is connected to a middle temperature controlling device 12b equipped with a middle thermocouple 11b for temperature measuring inserted in the middle position inside the vacuum reacting furnace 1D, and the power source 10c for the lower heat-producing element is connected to a lower temperature controlling device 12c equipped with lower thermocouple 11c for temperature measuring inserted in the lower position inside the vacuum reacting furnace 1D. Thus, it is so designed that the temperature at the upper, middle and lower positions inside the vacuum reacting furnace 1D are detected for automatically controlling AC voltage to be impressed upon the heat-producing elements 4a, 4b, 4c individually. The other construction is the same as in Embodiment No. 1.

Referring to the action by the apparatus of this embodiment, when DC voltage is impressed between the anode or inner wall screen bodies 5a, 5b, 5c and the cathode or a cathode mounting table 17 (namely, the workpiece 7) by the power source 9 for glow discharge, glow discharge is generated. On the other hand, when AC voltage is impressed upon the upper heat-producing element 4a, the middle heat-producing element 4b and the lower heat-producing element 4c by the power sources 10a, 10b and 10c for the heat-producing elements respectively, heat is generated. By the combined use of this glow discharge and heat generated by the heat-producing elements 4a, 4b, and 4c, the workpiece 7 is heated to the temperature at which nitriding is possible (300°–570° C., preferably 550°–560° C.). This heating is done uniformly in a short time. After the workpiece 7 has been heated to the above-mentioned treating temperature, the workpiece 7 is nitrided by glow discharge while it is kept at the treating temperature by heat generated by the heat-producing elements 4a, 4b, and 4c. At this time, the quantity of heat released at each portion is different and in this embodiment there is a tendency for the quantity of heat released to be more at the upper portion and less at the middle portion. The different quantity of heat released, namely, different temperatures at respective portions inside the vacuum reacting furnace 1D (having three portions—upper, middle and lower in this embodiment) are measured by respective thermocouples at the upper, middle and lower portions 11a, 11b, and 11c and according to the temperatures measured, output from power sources 10a, 10b, and 10c for the heat-producing elements is automatically controlled by temperature controlling devices 12a, 12b, and 12c respectively. Thus, AC voltage to be impressed upon heat-producing elements 4a, 4b, and 4c is controlled and, accordingly, temperatures at each portion inside the vacuum reacting furnace 1D are controlled to uniform distribution and to the desired degree (550°–560° C.), with the result that nitriding by glow discharge can be carried out uniformly and free from overheating of the workpieces. Since the heat-producing elements 4a, 4b, and 4c are arranged in such a fashion that they are screened electrically from the workpiece 7 (cathode) by the inner screen bodies 5a, 5b, and 5c and the outer wall cover bodies 6a, 6b, and 6c, there is no fear that arc discharge or unusual glow discharge is generated between the heat-producing elements 4a, 4b, and 4c and the workpiece 7 (cathode).

In this embodiment, the heat-producing element is divided into three portions but it is possible to divide it into two portions or more than four portions, without departing from the technical concept of this invention. From the aspect of uniformity of temperature distribution, it is preferable to divide the heat-producing element into at least three portions.

According to the present invention, heating and nitriding of the workpiece are carried out by the combined use of glow discharge and heat generated by the heat-producing element, and the temperature control on the workpiece is effected by the heat generation control on the heat-producing element or by the combination of the heat generation control on the heat-producing element and glow discharge control. Accordingly, the present invention has such advantages that heating and nitriding of the workpiece can be carried out at high thermal efficiency and with uniformity; treating efficiency per cycle can be raised to a great degree; the workpiece temperature can be controlled to the proper degree and with good responsiveness, with the result that overheating of the workpiece can be prevented and good nitrided layers can be obtained. Moreover, the apparatus according to the present invention is simple in construction and provides the accurate temperature control.

Furthermore, by controlling the voltage to be impressed upon the heat-producing element to 220 V at the maximum, heating and nitriding of the workpiece can be done on a continuous basis and at high thermal efficiency and treating efficiency per cycle can be raised to a great degree. In addition, by using the heat generated by the heat-producing element while controlling the voltage to be impressed upon the heat-producing element below 200 V, generation of arc discharge between heat-producing element terminals, between heat-producing element terminals and the anode and between the heat-producing element and the anode can be prevented, thereby resulting in uniform heating of the workpiece. Uniform temperature distribution and uniform ion-nitriding can be obtained and damage to the heat-producing element terminals, heat-producing elements and anode by overheating can be prevented.

Lastly, by dividing the heat-producing element into at least two portions, output at each portion can be controlled by a respective temperature controlling device, and therefore, temperature distribution in the furnace at the time of nitriding by glow discharge can be kept in good and uniform condition, with resultant better and more uniform nitriding treatment.

What is claimed is:

1. In an apparatus for ion-nitriding a workpiece, said apparatus having:

a vacuum reacting furnace adapted to receive said workpiece;

a heat-producing element inside said vacuum reacting furnace;

an inner wall screening body between said heat-producing element and said workpiece for electrically screening said heat-producing element from said workpiece;

a first power source connected between said screening body and said workpiece for creating glow discharge by impressing DC voltage between said screening body as an anode and said workpiece as a cathode; and a second power source connected to said heat-producing element for heating said heat-producing element by impressing AC voltage upon said heat-producing element, whereby said workpiece is heated and ion-nitrided by the combined use of said glow discharge and heat generated by said heat-producing element;

an improvement comprising:

control means connected to said first and second power sources for controlling the temperature inside said furnace by concurrently controlling the voltage impressed from said first and second power sources in relation to the temperature inside said furnace, whereby the heat generated by said heat-producing element and the heat generated during glow discharge are maintained at desired levels, said voltage impressed by said second power source to said heat-producing element having a maximum value of 220 volts.

2. An improved ion-nitriding apparatus as claimed in claim 1, wherein: said heat-producing element is divided into at least two sections in the lateral direction;

a plurality of power sources are provided, one power source being connected to each heat-producing element section; and a temperature controlling device is connected to each power source for detecting the temperature inside said furnace at that part corresponding to the divided heat-producing element section corresponding to the power source, whereby the power source for each heat-producing element section is controlled by the temperature at the respective position inside said furnace.

* * * * *